United States Patent [19]

Conroy

[11] 3,964,710

[45] June 22, 1976

[54] SUSPENDED CEILING LEVELING DEVICE

[75] Inventor: Andrew Conroy, Newark, N.J.

[73] Assignee: Lawrence Peska Associates, Inc., New York, N.Y. ; a part interest

[22] Filed: Dec. 6, 1974

[21] Appl. No.: 530,190

[52] U.S. Cl. ..... 248/206 R; 248/262; 269/21

[51] Int. Cl.[2] ..... F16B 47/00

[58] Field of Search..... 269/21, 95; 248/206 R, 248/310, 262, 263, 226 R

[56] References Cited

UNITED STATES PATENTS 2,104,515 1/1938 Golden..... 33/27 C X

FOREIGN PATENTS OR APPLICATIONS 876,073 8/1961 United Kingdom..... 248/206 R

*Primary Examiner*—Richard E. Aegerter
*Assistant Examiner*—Michael H. Thaler
*Attorney, Agent, or Firm*—Richard E. Nanfeldt

[57] ABSTRACT

A suspended ceiling leveling device is used to install a 90° angle component of a gird assembly for a suspended ceiling in a level horizontal plane. The device comprises a body member engaging a vertical wall, wherein a 90° angle component rest within a pair of devices. A suction cup affixed to an end of a handle assembly cooperates with the body member, wherein the suction cup engages the vertical wall holding the body member flush to the vertical wall.

1 Claim, 5 Drawing Figures

SUSPENDED CEILING LEVELING DEVICE

SUMMARY OF THE INVENTION

My invention relates to a unique and novel device for installing and leveling a 90° angle component of a gird assembly for a suspended ceiling.

Our patent search resulted in a number of clamp devices, but these U.S. Pat. Nos.: 482,645; 2,100,918; 2,190,463; 2,311,525; and 3,365,161 are inapplicable to my present invention.

It is an object of my present invention to provide a device for installing and leveling a 90° angle component of a gird assembly for a suspended ceiling.

It is a further object of my present invention to provide a means for temporary attachment to a vertical wall without maring the wall.

A still further object of my present invention is to provide a device of simple design easily used by an ordinary layman.

Briefly, my present invention comprises a body member engaging a vertical wall, wherein a 90° angle component rest within a pair of the body members. A suction cup affixed to an end of a handle assembly cooperates with the body member, wherein the suction cup engages the vertical wall holding the body member flush to the vertical wall.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 5:
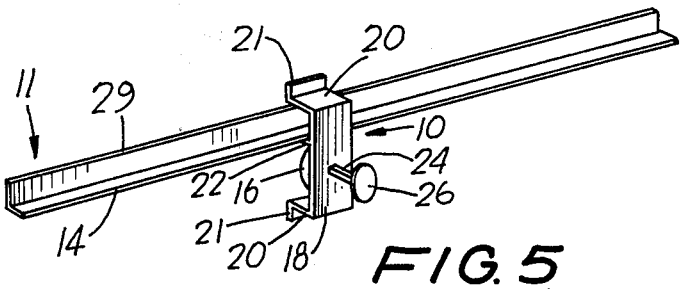
FIG. 5 illustrates a perspective view of the invention in use.

Turning now descriptively to the drawings, in which similar reference characters denote similar elements throughout the several views, FIG. 5 shows a suspended ceiling leveling device 10 used to install a 90° angle component 11 of a gird assembly for a suspended ceiling in a level horizontal plane. For the installation of each 90° angle component 11, two devices 10 are affixed to a vertical wall 13. The component 11 is leveled by vertical height adjustment of each device 10.

FIGS. 1–4 show the suspended ceiling leveling device, which comprises a body member 15, a suction cup 16, and a handle assembly 17 cooperating with the body member 15 and the suction cup 11. The body member 15 consist of an elongated rectangular plate 18 having affixed L-shaped flange member 19, wherein the longer leg 20 of each member 19 is perpendicular to the plate 18. The shorter leg 21 of each member 19 extends outward from leg 20 in a plane parallel to plate 18. A smaller rectangular shaped plate 22 is affixed perpendicularly to plate 18 between flange members 19, wherein plate 22 is in a cis configuration to flange members 19. The plate 18 has a transverse aperture 23 positioned between plate 22 and one flange member 19. An elongated rod member 24 is slidably contained within a guide assembly 25 mounted onto the inside face 30 of plate 18 at aperture 23, wherein rod member 24 can be moved back and forth within guide assembly 25 in a place parallel to flange member 19. A circular disc handle 26 is affixed to the outer end 27 of rod member 24, wherein handle 26 is contained outside of the body member 15. The suction cup 16 is affixed to the other end 28 of rod member 24, wherein suction cup is positioned within the body member between plate 22 and one flange member 19. In use the shorter legs 21 of the body member 15 engage the vertical wall 13 as well as the suction cup 16. The 90° angle component rests on top of plate 22 of the body member 15.

Figure 1:
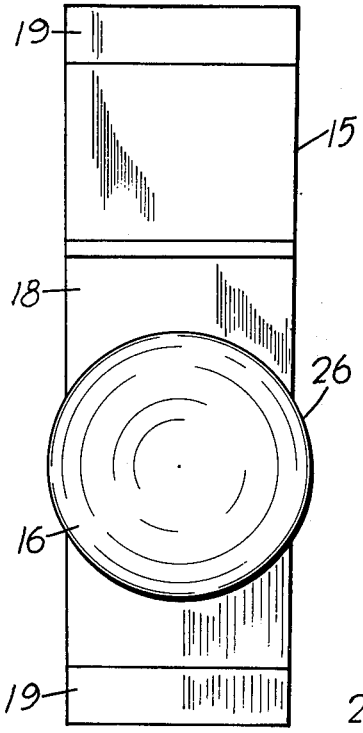
FIG. 1 illustrates a rear view of the invention.
Figure 2:
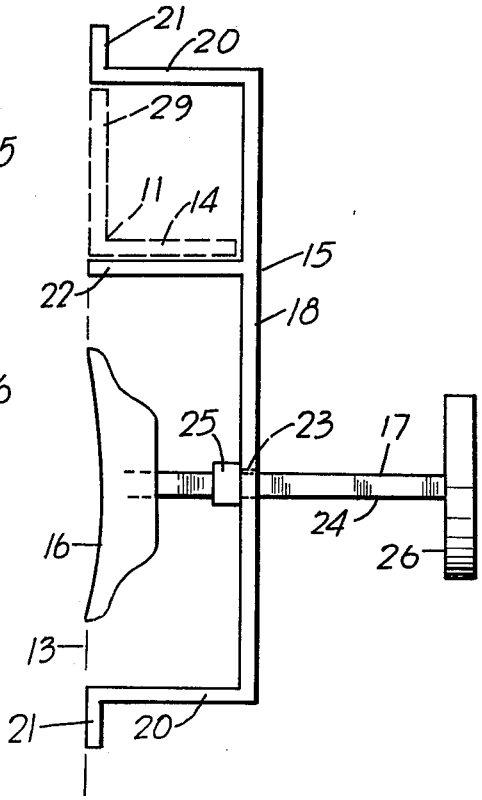
FIG. 2 illustrates a side view of the invention in use.
Figure 3:
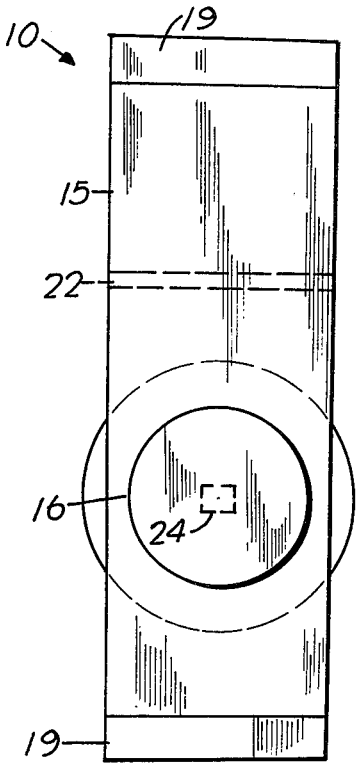
FIG. 3 illustrates a front view of the invention.
Figure 4:
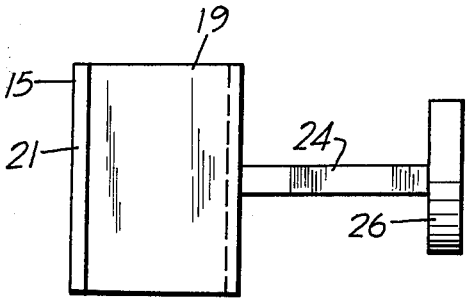
FIG. 4 illustrates a top view of the invention.

Referring back to FIG. 5, the horizontal section 14 of the component 11 rests on top of plate 22 within body member 15 as the vertical section 29 of the component 11 engages the vertical wall 13 as shown in FIG. 2.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A suspended ceiling leveling device for leveling a 90° angle component of a guide assembly of a suspended ceiling which comprises:

a. an elongated rectangularly shaped plate having a center transverse hole therethrough;

b. L-shaped flange members affixed perpendicularly to each end of said plate, each said L-shaped flange member having a longer leg and a shorter leg, said longer leg joined perpendicularly to said plate, said shorter leg of each said member parallel to said plate and extending away from said plate, each said shorter leg adapted to engage a vertical wall;

c. a smaller flat rectangularly shaped plate affixed perpendicularly to said elongated rectangularly shaped plate between one said L-shaped flange member and said hole, said smaller plate positioned on the same side of said larger plate as each said L-shaped flange member, said 90° angle component adapted to rest on top of said smaller plate and engage against said vertical wall;

d. a guide assembly mounted onto larger plate at said transverse hole, said guide assembly positioned on the same side of said larger plate as said L-shaped flange members;

e. a rod member slidably contained in said guide assembly, said rod member extending through said guide assembly and said transverse hole;

f. a circular disc handle affixed to one end of said rod member, said handle being positioned on an opposite side of said large plate to that of L-shaped flange members; and g. a suction cup member affixed to another end of said rod member, said suction cup member positioned on said same side of said larger plate as said L-shaped flange members, said suction cup positioned between one said flange member and said smaller plate, said suction cup member engaging said vertical wall.

* * * * *